US008416138B2

(12) United States Patent
Quddus

(10) Patent No.: US 8,416,138 B2
(45) Date of Patent: Apr. 9, 2013

(54) MULTIBAND ANTENNA INCLUDING ANTENNA ELEMENTS CONNECTED BY A CHOKING CIRCUIT

(75) Inventor: Momin Quddus, Camarillo, CA (US)

(73) Assignee: Calamp Corp., Oxnard, CA (US)

( * ) Notice: Subject to any disclaimer, the term of this patent is extended or adjusted under 35 U.S.C. 154(b) by 260 days.

(21) Appl. No.: 12/345,492

(22) Filed: Dec. 29, 2008

(65) Prior Publication Data

US 2010/0164819 A1 Jul. 1, 2010

(51) Int. Cl.
*H01Q 1/00* (2006.01)

(52) U.S. Cl.
USPC ..... 343/722; 343/702

(58) Field of Classification Search ..... 343/700 MS, 343/722, 702
See application file for complete search history.

(56) References Cited

U.S. PATENT DOCUMENTS

| | | | | |
|---|---|---|---|---|
| 6,380,895 | B1 * | 4/2002 | Moren et al. | 343/700 MS |
| 6,429,821 | B1 * | 8/2002 | Lewis, Jr. | 343/749 |
| 6,642,895 | B2 * | 11/2003 | Zurcher et al. | 343/718 |
| 2008/0174503 | A1 * | 7/2008 | Kim et al. | 343/722 |

* cited by examiner

*Primary Examiner* — Dieu H Duong
(74) *Attorney, Agent, or Firm* — Kauth, Pomeroy, Peck & Bailey LLP

(57) ABSTRACT

Multiband antennas are disclosed that incorporate a high frequency antenna element connected to a low frequency antenna element by a choking circuit. The choking circuit couples the high frequency antenna element to the low frequency antenna at a low frequency band and decouples the high frequency antenna element at a high frequency band. The connection created by the choking circuit can be a direct connection or can be an indirect connection via coupling elements that are capactively coupled to the high frequency antenna element and/or the low frequency element to increase the bandwidth of the multiband antenna. One embodiment includes a high frequency antenna element including a feed, and a low frequency antenna element connected to the high frequency antenna element via a choking circuit.

24 Claims, 3 Drawing Sheets

MULTIBAND ANTENNA INCLUDING ANTENNA ELEMENTS CONNECTED BY A CHOKING CIRCUIT

FIELD OF THE INVENTION

The present invention relates generally to multiband antennas and more specifically to efficient multiband antenna designs incorporating multiple antenna elements.

BACKGROUND

Cellular networks are increasingly used to connect to devices via wireless data links. Depending upon the cellular network, cellular communication can occur in one of number of frequency bands allocated for the purpose by the relevant regulatory authority. A device can be configured to communicate in multiple bands provided the device includes an antenna that has resonances in each of the bands.

A variety of different types of antennas are used in mobile applications including antennas that are external to the device such as helix and retractable antennas, and antennas that can be embedded within a device such as "inverted F" and folded dipole antennas. Embedding a device antenna within a mobile device case or housing is often preferable to prevent damage to the antenna and to reduce the form factor the mobile device. Embedded antennas can be constructed by printing metal circuit traces on a dielectric substrate of a printed circuit board (PCB). The resonance of such antennas typically depends upon the dimensions of the circuit traces and the dielectric constant of the PCB dielectric layers. As a general rule, the lower the resonant band of the antenna the larger the antenna.

A single antenna element can be used to transmit in multiple bands. However, wide-band operation of an antenna element typically sacrifices performance of the antenna elements and such wide-band operation is only practical for relatively closely spaced operating frequency bands. Therefore, operation at multiple frequency bands is typically supported using multiple antenna elements.

In a multiple-element antenna, different antenna elements are tuned for operation at different operating frequency bands. For example, suitably tuned separate antenna elements enable a multiple-element antenna to operate with Global System for Mobile Communications (GSM) and General Packet Radio Service (GPRS) and/or Code Division Multiple Access (CDMA) in the European and Asian frequency bands at approximately 900 MHz and 1800 MHz, or at the North American frequency bands at approximately 850 MHz and 1900 MHz.

Increasing integration is enabling the construction of small devices possessing high levels of functionality. For example, tracking devices including a GPS receiver and a microprocessor can now be constructed on a printed circuit board contained within a package having a size of 2.75"×2"×1". As device form factors shrink, the size of a device's antenna can become a limiting factor. Reducing the size of an antenna typically reduces its efficiency. Therefore, reducing the size of an antenna in order to shrink a device's form factor can significantly impact the device's power consumption.

SUMMARY OF THE INVENTION

Multiband antennas in accordance with embodiments of the invention include a high frequency element and a low frequency element connected via a choking circuit. One embodiment of the invention includes a high frequency antenna element including a feed, and a low frequency antenna element connected to the high frequency antenna element via a choking circuit. In addition, the choking circuit is configured to couple the low frequency antenna element to the high frequency antenna element in a low frequency band and decouple the high frequency antenna element from the low frequency antenna element in a high frequency band.

In a further embodiment of the invention, the choking circuit is a low pass filter with a cut off between the low frequency band and the how frequency band.

In another embodiment of the invention, the high frequency antenna element and the low frequency antenna element are formed on a printed circuit board.

In a still further embodiment of the invention, the high frequency antenna element is directly fed by a microstrip transmission line.

In still another embodiment of the invention, the choking circuit is a low pass filter with a cut off between the low frequency band and the high frequency band.

In a yet further embodiment of the invention, the choking circuit comprises a meander line circuit trace formed on the PCB.

In yet another embodiment of the invention, the choking circuit further comprises a resistor mounted to the printed circuit board and connected in parallel with the meander line circuit trace.

In a further embodiment of the invention again, the choking circuit is directly connected to the high frequency antenna element.

In another embodiment of the invention again, the choking circuit is directly connected to the low frequency antenna element.

A further additional embodiment of the invention also includes at least one coupling element capacatively coupled to the high frequency antenna element, where the capactive coupling of the coupling element increases the bandwidth of the multiband antenna in at least the high frequency band.

Another additional embodiment of the invention also includes at least one coupling element capactively coupled to the high frequency antenna element, and at least one coupling element capactively coupled to the low frequency antenna element. In addition, the choking circuit is directly connected to one of the coupling elements capactively coupled to the high frequency antenna element and one of the coupling elements capacitively coupled to the low frequency antenna element.

In a still yet further embodiment of the invention, the high frequency antenna element forms a ground plane independent floating antenna in the high frequency band.

In still yet another embodiment of the invention, the high frequency antenna element, the choking circuit and the low frequency antenna element form a ground plane independent floating antenna in the low frequency band.

A still further embodiment of the invention again also includes at least one coupling element capactively coupled to the high frequency antenna element. In addition, the high frequency antenna element and the at least one coupling element form a ground plane independent floating antenna in the high frequency band.

In still another embodiment of the invention again, the high frequency antenna element, the at least one coupling element, the choking circuit, and the low frequency antenna element form a ground plane independent floating antenna in the low frequency band.

A still further additional embodiment of the invention also includes at least one coupling element capacitively coupled to the low frequency antenna element. In addition, the high frequency antenna element, the at least one coupling element capacitively coupled to the high frequency antenna element, the choking circuit, the low frequency antenna element, and the at least one coupling element capactively coupled to the low frequency antenna element form a ground plane independent floating antenna in the low frequency band.

In another additional embodiment of the invention, the choking circuit indirectly couples the high frequency antenna element and the low frequency antenna element via one of the coupling elements capactively coupled to the high frequency antenna element and one of the coupling elements capactively coupled to the low frequency antenna element.

In a yet further embodiment again of the invention, the dimensions of the high frequency provide the multiband antenna with a frequency response in a desired high frequency band without impedance matching.

In yet another embodiment again of the invention, the dimensions and location of the low frequency element provide the multiband antenna with a frequency response in a desired low frequency band without impedance matching.

In a yet further additional embodiment again of the invention, the choking circuit comprises an inductive component, and the choking circuit is located on the printed circuit board to avoid cross coupling between an inductive component and the choking circuit.

DETAILED DESCRIPTION OF THE INVENTION

Turning now to the drawings, compact multiband antennas in accordance with embodiments of the invention are described. In many embodiments, the multiband antenna includes a high frequency antenna element and a low frequency antenna element implemented using circuit traces formed on a printed circuit board. The low frequency antenna element and the high frequency antenna element are connected by a choking circuit, which couples the high frequency antenna element to the low frequency antenna element during operation in a low frequency band and decouples the antenna elements during operation in a high frequency band. In a number of embodiments, the antenna includes one or more capacitively coupled elements to increase the bandwidth of the antenna and/or increase the antenna Q.

Choking circuits in accordance with many embodiments of the invention are implemented using a passive low pass filter. In several embodiments, the choking circuit incorporates a meander line circuit trace, which acts as an inductive component. When dimensioned appropriately, the meander line circuit trace attenuates frequencies in a high frequency band of operation of an antenna and passes frequencies in a low frequency band with very little impedance. In a number of embodiments, more complex low pass filter circuits are used in the implementation of the choking circuit. For example, the choking circuit can be implemented as a meander line trace in parallel with a resistor. In other embodiments, a variety of choking circuits utilizing meander line circuit traces as inductive elements are utilized.

Figure 1:
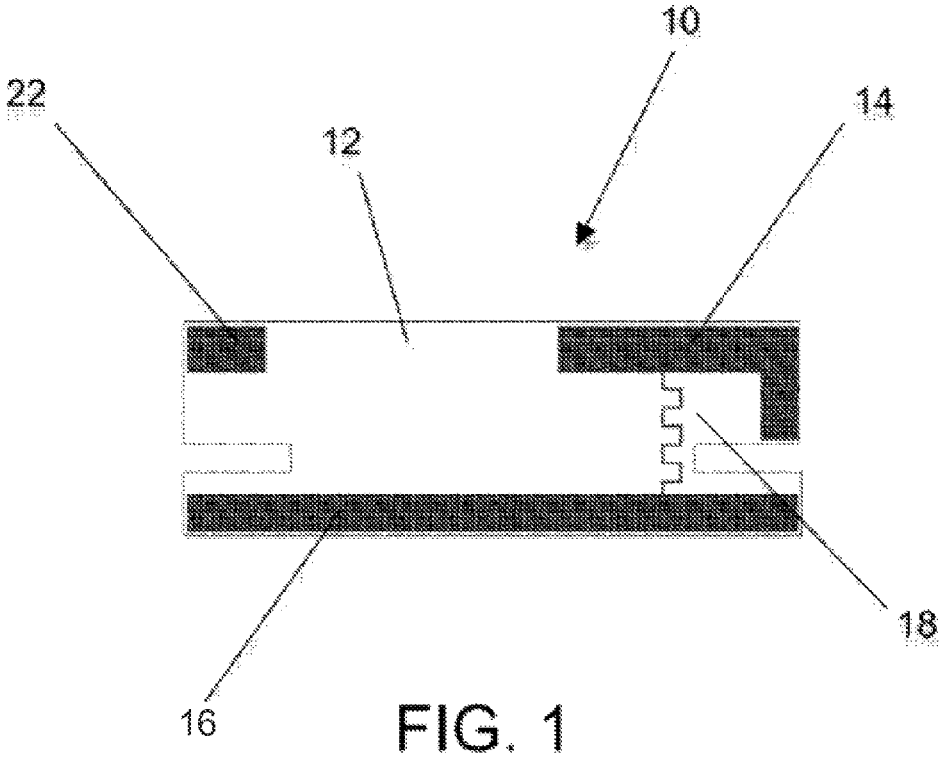
FIG. 1 is a top view of a multiband antenna formed on a printed circuit board in accordance with an embodiment of the invention.
Figure 2:
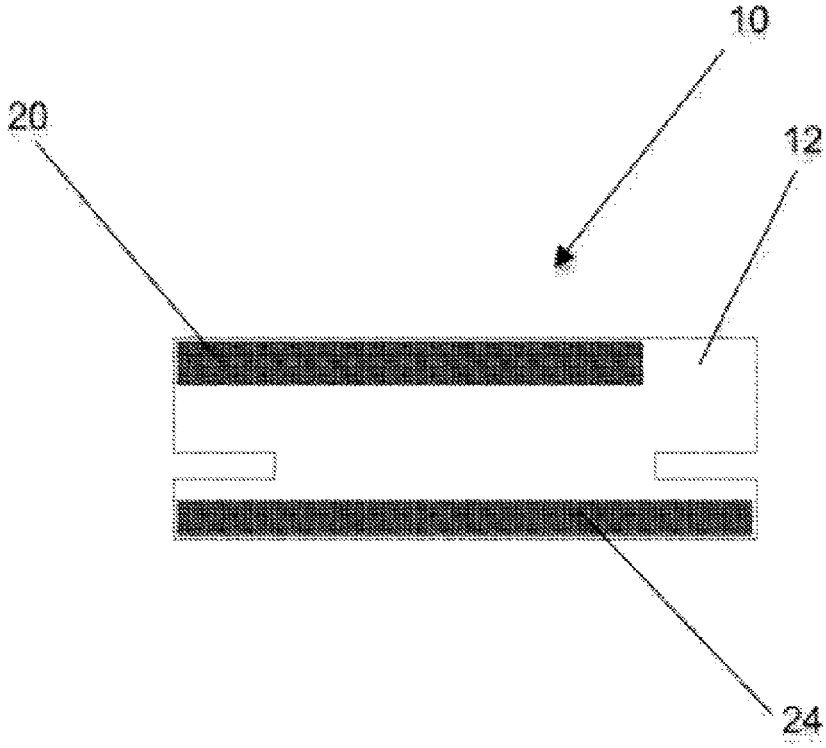
FIG. 2 is a bottom view of the multiband antenna shown in FIG. 2.

A multiband antenna in accordance with an embodiment of the invention that incorporates ground plane independent floating antenna elements coupled by a choking circuit is illustrated in FIGS. 1 and 2. The multiband antenna 10 is implemented on a printed circuit board 12 and includes a high frequency antenna element 14 connected to a low frequency antenna element 16 via a choking circuit 18 implemented as a meander line circuit trace. The antenna also includes capactively coupled elements 20, 22, and 24 that can increase the bandwidth of the antenna in each of its resonant modes and/or increase the antenna Q (i.e. the ratio of energy stored to energy lost). In operation, the choking circuit 18 couples the high frequency antenna element and the low frequency antenna element when the antenna operates within a low frequency band and decouples the high frequency antenna element and the low frequency antenna element when the antenna operates in a higher frequency band. Effectively, the choking circuit acts as a low pass filter that has a cut off frequency between the low frequency band and the high frequency band of the antenna. The high frequency antenna element 14 and the capacitively coupled elements 20, 22 form a ground plane independent floating antenna that resonates in a desired high frequency band. The high frequency antenna element 14, the meander line circuit trace, the low frequency antenna element 16, and the capacitively coupled elements 20, 22, 24 combine to form a ground plane independent floating antenna that resonates in a desired low frequency band. The choking circuit decouples the high frequency antenna element 14 and the capacitively coupled elements 20, 22 during operation in the high frequency band. While capacitively coupled elements are typically added to increase the bandwidth of the antenna in the high and low frequency mode, the capactively coupled elements can also create a third resonant mode of operation.

In the illustrated embodiment, the high frequency antenna element 14 is an L shaped element that is readily fed from a circuit board by a microstrip transmission line. The low frequency antenna element is implemented by a rectangular conductor section 16 positioned on an opposite edge of the printed circuit board 12 to increase the width of the antenna in low frequency mode. The low frequency antenna element does not include a feeding port and is intended to operate in conjunction with the high frequency antenna element via the choking circuit. The choking circuit is implemented as a meander line circuit trace 18, which extends in a direction perpendicular from the high frequency antenna element 14 and connects to the low frequency antenna element 16. The choking circuit is typically positioned in such a way as to prevent cross coupling between the inductor and the antenna elements, which would reduce the choking effect of the circuit.

The resonance of the high frequency mode of the antenna can be tuned by adjusting the width and shape of the high frequency antenna element and the resonance of the low frequency mode of the antenna can be tuned by adjusting the length of the low frequency antenna element and the position of the low frequency antenna element relative to the high frequency antenna element. In addition, the meander line circuit trace is dimensioned so that the choking circuit has a cut off frequency between the high frequency band and the low frequency band. Ideally, the choking circuit will pass as much of the low frequency band as possible and as little of the high frequency band as possible.

Although the illustrated embodiment implements a choking circuit using a single meander line circuit trace, other passive low pass filters can be implemented to achieve the desired choking effect. In one embodiment particularly suited for cellular communication, the antenna elements are tuned to provide a low frequency resonance in the 800 MHz band and a high frequency resonance in the 1800 MHz band. Additionally, the capacitively coupled elements that increase the bandwidths of both the high and low frequency bands can also be tuned to create a third resonant mode in the frequency band used by the Global Positioning System. In other embodiments, the high frequency and low frequency resonances of the antenna can be tuned in accordance with the requirements of the application.

In a number of embodiments, tuning of the antenna elements can be particularly important in preserving the gain and antenna Q. Many antenna designs rely on impedance matching to achieve desired resonant modes. Impedance matching increases the loss of the antenna. By tuning the elements of the antenna for desired resonant modes, the loss associated with the inclusion of choking circuit can be offset somewhat by eliminating the need and therefore the losses associated with impedance matching. Although in several embodiments, impedance matching is utilized as the impact on antenna gain can be tolerated by the application.

The multiband antenna illustrated in FIGS. 1 and 2 is simply one configuration in accordance with an embodiment of the invention. Multiband antennas that include choking circuits that couple antenna elements in a manner that is dependent upon frequency band can be implemented using a variety of configurations in accordance with embodiments of the invention. In addition, the choking circuit can be directly connected to the high frequency antenna element and the low frequency antenna element (i.e. involving a physical connection between the choking circuit and the high frequency and low frequency antenna elements) or indirectly connected to the high frequency antenna element and the low frequency antenna element via other elements of the antenna including capacitively coupled elements (i.e. a connection that does not involve a direct physical connection between the choking circuit and the high frequency and low frequency antenna elements).

Figure 3:
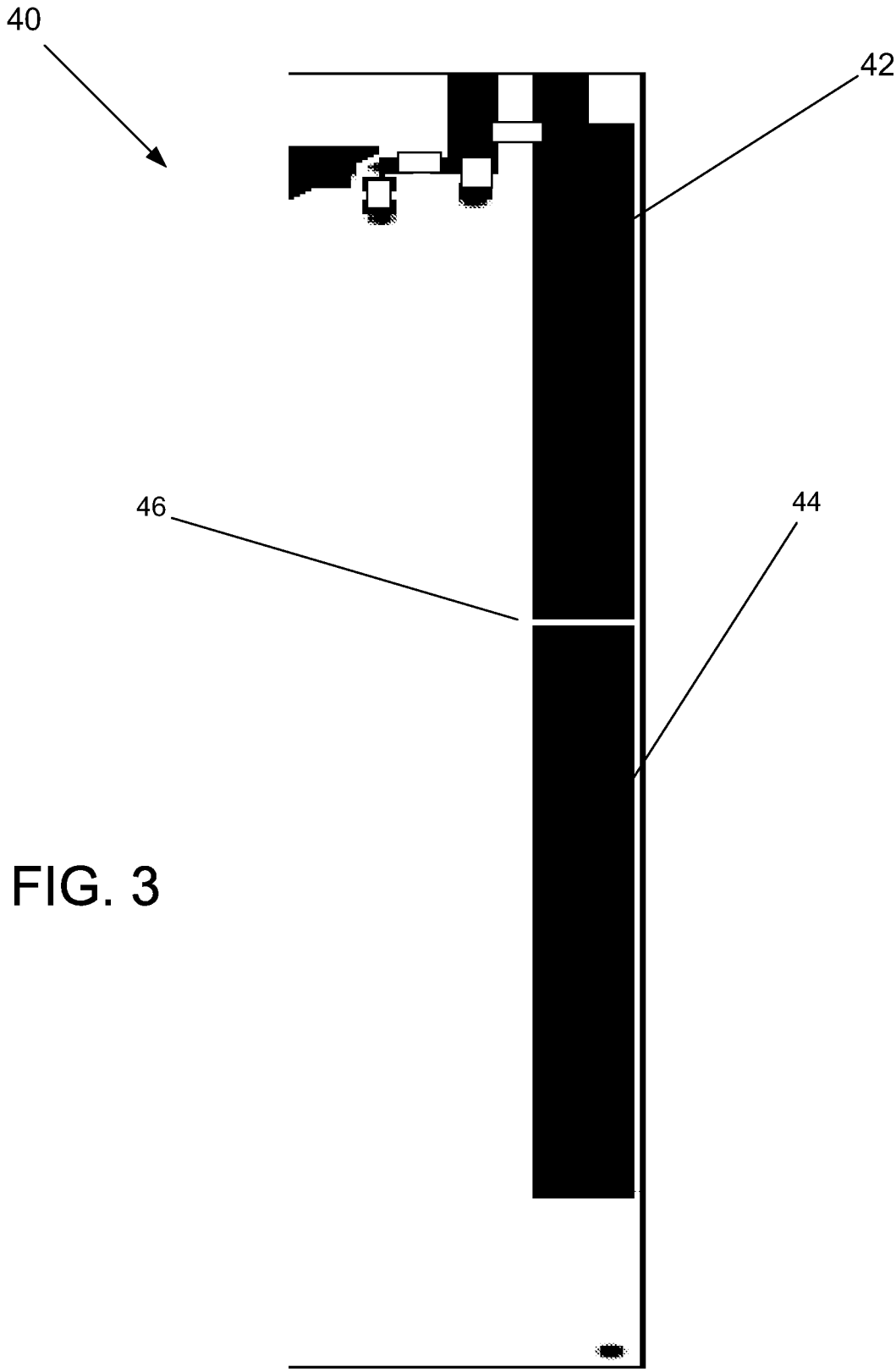
FIG. 3 is a top view of a multiband antenna formed on a printed circuit board in accordance with a further embodiment of the invention.
Figure 4:
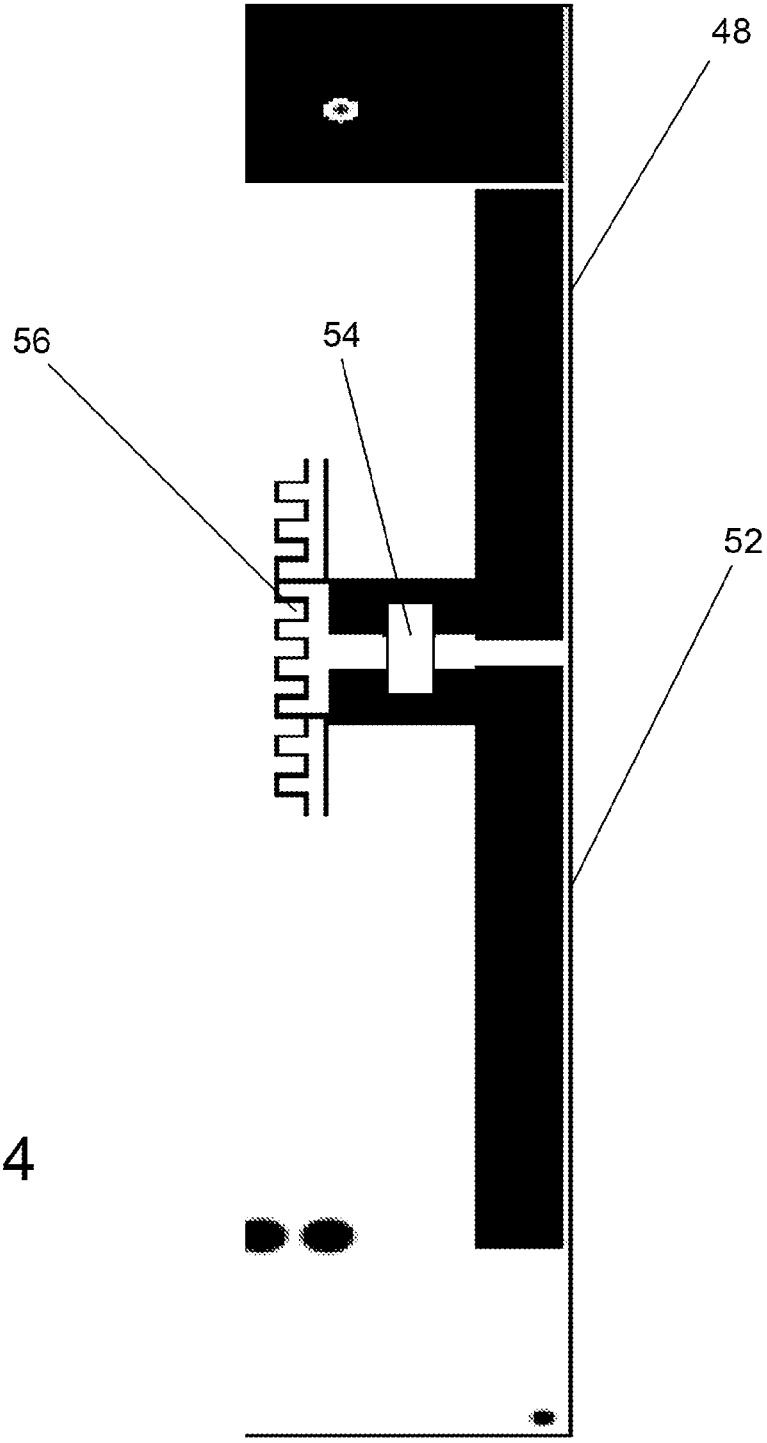
FIG. 4 is a bottom view of the multiband antenna shown in FIG. 3.

A multiband antenna that includes a choking circuit that is indirectly connected to a high frequency antenna element and a low frequency antenna element in accordance with an embodiment of the invention is illustrated in FIGS. 3 and 4. As with the embodiment illustrated in FIGS. 1 and 2, the multiband antenna 40 shown in FIGS. 3 and 4 includes a high frequency antenna element connected to a low frequency antenna element via a choking circuit. However, the implementation obtains resonances in both a high frequency band and a low frequency band by coupling a low frequency antenna element to the high frequency antenna element that makes the antenna longer instead of making the antenna wider. The multiband antenna 40 includes a generally rectangular high frequency antenna element 42 that acts as a ground plane independent floating antenna when the antenna is operated in a high frequency band. The multiband antenna 40 also includes a rectangular low frequency antenna element 44 aligned in a straight line with the high frequency antenna element and separated from the high frequency antenna element by a small gap 46. The high frequency antenna 42 element is capacitively coupled to a coupling element 48 that acts to increase the bandwidth of the resonant modes of the antenna. The low frequency antenna element 44 is also capacitively coupled to a coupling element 52. The high frequency antenna element and the low frequency antenna element are connected via a choking circuit. Unlike the multiband antenna 10 shown in FIGS. 1 and 2 where the low frequency antenna element and the high frequency antenna element are directly connected by the choking circuit, the choking circuit of the multiband antenna 40 shown in FIGS. 3 and 4 indirectly connects the high frequency antenna element 42 and the low frequency antenna element 44 via the coupling elements.

In the illustrated embodiment, the choking circuit includes a resistor 54 and meander line circuit trace 56 connected in parallel between the coupling elements 48, 52. As discussed above, any inductive elements in the choking circuit should be positioned to limit cross coupling with the antenna elements. A meander line circuit trace positioned in close proximity to the high frequency antenna element 42 can result in cross coupling rendering a direct connection between the high frequency antenna element 42 and the low frequency antenna element 44 using a meander line circuit trace undesirable. The L shaped coupling elements 48, 52 extend away from the high frequency antenna element and at their extremities provide a point in which a connection can be made via a meander line circuit trace 56 with negligible cross coupling. The resistor 54 and the meander line circuit trace 56 form a passive low pass fitter that connects the coupling elements 48, 52 at a low frequency band and decouples the coupling elements 48, 52 at a high frequency band. The resistive element increases radiation resistance and improves the return loss of the antenna.

As with the embodiment shown in FIGS. 1 and 2, the multiband antenna 40 shown in FIGS. 3 and 4 includes antenna elements that are tuned to the required high frequency and low frequency operational bands. Tuning the antenna elements maximizes the gain of the antenna by avoiding the use of an impedance matching circuit, which would introduce a loss. Capacitively coupled elements can play an important role in providing a precise frequency response. For large antennas with considerable spacing between the antenna elements, antenna Q is high and desired performance can be achieved without use of capacitively coupling elements. As the dimensions of the antenna are reduced, however, adding capacitively coupled elements can provide a wider frequency response and increase antenna Q. Accordingly, capacitively coupled elements can be extremely useful in tuning the frequency response of a multiband antenna in accordance with an embodiment of the invention as the size of the antenna is decreased.

While the above description contains many specific embodiments of the invention, these should not be construed as limitations on the scope of the invention, but rather as an example of one embodiment thereof. For example, the embodiments described above utilize antenna elements that form ground plane independent floating antennas. In many embodiments, other types of antenna elements including, but not limited to, monopole antennas, dipole antennas, loop antennas, and patch antennas may be connected via a choking circuit. Accordingly, the scope of the invention should be determined not by the embodiments illustrated, but by the appended claims and their equivalents.

What is claimed is:

1. A multiband antenna, comprising:

a printed circuit board having a first edge and a second edge, where the first edge and the second edge are parallel to each other and on opposite sides of the printed circuit board;

a high frequency antenna element configured to receive a feed, where the resonance of the multiband antenna in a high frequency mode is determined by the width and shape of the high frequency antenna element, the high frequency antenna element is formed along the first edge of the printed circuit board, the high frequency antenna element is of a substantially elongated shape having a long axis and a short axis;

a low frequency antenna element connected to the high frequency antenna element via a choking circuit, where the low frequency antenna element is formed along the second edge of the printed circuit board parallel to the high frequency antenna element, the low frequency antenna element is of a substantially elongated shape having a long axis and a short axis, where the long axis of the low frequency antenna element is parallel to the long axis of the high frequency antenna element;

wherein the choking circuit comprises a meander line circuit trace formed on the printed circuit board substantially perpendicular to the long axis of the high frequency antenna element and the long axis of the low frequency antenna element, where:

the choking circuit is configured to act as an inductive component;

the meander line circuit trace extends between the high frequency antenna element and the low frequency antenna element; and the substantially perpendicular orientation relative to the long axis of the high frequency antenna element of the meander line circuit trace limits cross coupling between the high frequency antenna element and the meander line circuit trace;

wherein the choking circuit is configured to couple the low frequency antenna element to the high frequency antenna element in a low frequency band and decouple the high frequency antenna element from the low frequency antenna element in a high frequency band; and wherein the low frequency antenna element is positioned to increase the width of the multiband antenna in a low frequency mode and the resonance of the multiband antenna in the low frequency mode is determined by the length and position of the low frequency antenna element relative to the high frequency antenna element.

2. The multiband antenna of claim 1, wherein the choking circuit is a low pass filter with a cut off between the low frequency band and the high frequency band.

3. The multiband antenna of claim 1, wherein the high frequency antenna element is directly fed by a microstrip transmission line.

4. The multiband antenna of claim 1, wherein the choking circuit is a low pass filter with a cut off between the low frequency band and the high frequency band.

5. The multiband antenna of claim 1, wherein the choking circuit further comprises a resistor mounted to the printed circuit board and connected in parallel with the meander line circuit trace.

6. The multiband antenna of claim 1, wherein the choking circuit is directly connected to the high frequency antenna element.

7. The multiband antenna of claim 1, wherein the choking circuit is directly connected to the low frequency antenna element.

8. The multiband antenna of claim 1, further comprising at least one coupling element capacitively coupled to the high frequency antenna element, where the capacitive coupling of the coupling element increases the bandwidth of the multiband antenna in at least the high frequency band.

9. The multiband antenna of claim 1, further comprising:

at least one coupling element capacitively coupled to the high frequency antenna element;

at least one coupling element capacitively coupled to the low frequency antenna element;

wherein the choking circuit is directly connected to one of the coupling elements capacitively coupled to the high frequency antenna element and one of the coupling elements capacitively coupled to the low frequency antenna element.

10. The multiband antenna of claim 1, wherein the high frequency antenna element forms a ground plane independent floating antenna in the high frequency band.

11. The multiband antenna of claim 10, wherein the high frequency antenna element, the choking circuit and the low frequency antenna element form a ground plane independent floating antenna in the low frequency band.

12. The multiband antenna of claim 1, further comprising:

at least one coupling element capactively coupled to the high frequency antenna element;

wherein the high frequency antenna element and the at least one coupling element form a ground plane independent floating antenna in the high frequency band.

13. The multiband antenna of claim 12, wherein the high frequency antenna element, the at least one coupling element, the choking circuit, and the low frequency antenna element form a ground plane independent floating antenna in the low frequency band.

14. The multiband antenna of claim 12, further comprising:

at least one coupling element capacitively coupled to the low frequency antenna element;

wherein the high frequency antenna element, the at least one coupling element capacitively coupled to the high frequency antenna element, the choking circuit, the low frequency antenna element, and the at least one coupling element capactively coupled to the low frequency antenna element form a ground plane independent floating antenna in the low frequency band.

15. The multiband antenna of claim 14, wherein the choking circuit indirectly couples the high frequency antenna element and the low frequency antenna element via one of the coupling elements capactively coupled to the high frequency antenna element and one of the coupling elements capactively coupled to the low frequency antenna element.

16. The multiband antenna of claim 1, wherein:

the choking circuit comprises an inductive component; and the choking circuit is located on the printed circuit board to avoid cross coupling between an inductive component and the choking circuit.

17. A multiband antenna, comprising:

a printed circuit board;

a high frequency antenna element formed on the printed circuit board and configured to receive a feed, where the high frequency antenna element is of a substantially elongated shape having a long axis and a short axis;

a low frequency antenna element formed on the printed circuit board, connected to the high frequency antenna element via a choking circuit and aligned in a straight line with the high frequency antenna element, where the low frequency antenna element is of a substantially elongated shape having a long axis and the long axis of the low frequency antenna element is parallel to the long axis of the high frequency antenna element;

wherein the choking circuit comprises a meander line circuit trace formed on a printed circuit board configured to act as an inductive component;

wherein the choking circuit is configured to couple the low frequency antenna element to the high frequency antenna element in a low frequency band and decouple the high frequency antenna element from the low frequency antenna element in a high frequency band; and wherein the meander line circuit trace is positioned away from and parallel to the straight line formed by the long axis of the high frequency antenna element and the long axis of the low frequency antenna element to provide negligible cross coupling between the high frequency antenna element and the meander line circuit trace.

18. The multiband antenna of claim 17, wherein the choking circuit is a low pass filter with a cut off between the low frequency band and the high frequency band.

19. The multiband antenna of claim 17, wherein the choking circuit further comprises a resistor mounted to a printed circuit board and connected in parallel with the meander line circuit trace.

20. The multiband antenna of claim 19, wherein the choking circuit is directly connected to at least one of the high frequency antenna element and the low frequency antenna element.

21. The multiband antenna of claim 19, further comprising at least one coupling element capacitively coupled to the high frequency antenna element, where the capacitive coupling of the coupling element increases the bandwidth of the multiband antenna in at least the high frequency band.

22. The multiband antenna of claim 19, further comprising:

at least one coupling element capacitively coupled to the high frequency antenna element; and at least one coupling element capacitively coupled to the low frequency antenna element.

23. The multiband antenna of claim 22, wherein the choking circuit indirectly couples the high frequency antenna element and the low frequency antenna element via one of the coupling elements capacitively coupled to the high frequency antenna element and one of the coupling elements capacitively coupled to the low frequency antenna element.

24. A multiband antenna, comprising:

a high frequency antenna element configured to receive a feed, where the resonance of the multiband antenna in a high frequency mode is determined by the width and shape of the high frequency antenna element;

a low frequency antenna element connected to the high frequency antenna element via a choking circuit;

wherein the choking circuit comprises a meander line circuit trace formed on a printed circuit board configured to act as an inductive component;

wherein the choking circuit is configured to couple the low frequency antenna element to the high frequency antenna element in a low frequency band and decouple the high frequency antenna element from the low frequency antenna element in a high frequency band;

wherein the low frequency antenna element is positioned to increase the width of the multiband antenna in a low frequency mode and the resonance of the multiband antenna in the low frequency mode is determined by the length and position of the low frequency antenna element relative to the high frequency antenna element;

wherein the meander line circuit trace extends between the high frequency antenna element and the low frequency antenna element;

wherein the direction in which the meander line circuit trace extends is configured to avoid cross coupling between the high frequency antenna element and the meander line circuit trace; and wherein the capacitively coupled high frequency antenna element and the low frequency antenna element are configured to resonate in a third frequency band separate from the low frequency band and the high frequency band.

* * * * *